US007155028B2

(12) United States Patent
Lin

(10) Patent No.: US 7,155,028 B2
(45) Date of Patent: Dec. 26, 2006

(54) VOICE COIL MOUNTING STRUCTURE

(75) Inventor: Steff Lin, Taipei Hsien (TW)

(73) Assignee: Sonodyne Taiwan Co., Ltd., Taipei (TW)

( * ) Notice: Subject to any disclaimer, the term of this patent is extended or adjusted under 35 U.S.C. 154(b) by 262 days.

(21) Appl. No.: 10/995,433

(22) Filed: Nov. 24, 2004

(65) Prior Publication Data

US 2006/0110003 A1 May 25, 2006

(51) Int. Cl.
*H04R 25/00* (2006.01)

(52) U.S. Cl. ..... 381/407; 381/400; 29/606

(58) Field of Classification Search ..... 381/400, 381/401, 406–410; 29/606, 602.01, 453; 336/192

See application file for complete search history.

(56) References Cited

U.S. PATENT DOCUMENTS 1,891,404 A * 12/1932 Engholm ..... 381/407
2,271,525 A * 2/1942 Seabert ..... 381/407
3,792,394 A * 2/1974 Bertagni ..... 381/410
5,647,014 A * 7/1997 Geisenberger ..... 381/400
6,594,885 B1 * 7/2003 Abdel-Tawab et al. ..... 29/606
2006/0110001 A1 * 5/2006 Saint Vincent et al. ..... 381/400

* cited by examiner

*Primary Examiner*—Sinh Tran
(74) *Attorney, Agent, or Firm*—Bacon & Thomas, PLLC

(57) ABSTRACT

Disclosed is a voice coil mounting structure, which includes a reel, which has a first end mounted with a coil and a second end provided with equiangularly spaced female retaining portions, and a reel holder, which defines an annular space for accommodating the second end of the reel and has female retaining portions provided inside the annular space for engagement with the female retaining portions to lock the reel to the reel holder upon a rotary motion of the reel relative to the reel holder after insertion of the second end of the reel into the annular space.

3 Claims, 6 Drawing Sheets

VOICE COIL MOUNTING STRUCTURE

BACKGROUND OF THE INVENTION

1. Field of the Invention

The present invention relates generally to a speaker and more particularly, to a voice coil mounting structure used in a speaker.

2. Description of the Related Art

According to conventional speaker fabrication methods, a voice coil is made by: winding a coil on one end of a reel and then adhering the reel to a cylindrical holder at the paper cone. During operation of the speaker, the voice coil is vibrated. This vibration action causes the voice coil to loose after a long time of use. When the voice coil of a speaker starts to loose, the quality of the performance of the speaker is obstructed. A badly loosen status of the voice coil may cause the speaker unable to function normally. Further, because the voice coil is directly sleeved onto the cylindrical holder at the speaker and then adhered thereto. It installation procedure is complicated, wasting much installation time.

SUMMARY OF THE INVENTION

The present invention has been accomplished under the circumstances in view. It is the main object of the present invention to provide a voice coil mounting structure, which enables the user to install the voice coil in the speaker easily and rapidly. It is another object of the present invention to provide a voice coil mounting structure, which holds the voice coil steadily in the speaker, maintaining the quality of the speaker. To achieve these and other objects of the present invention, the voice coil mounting structure comprises a. reel, and a reel holder. The reel has a first end, a second end, a coil wound round the first end, and a plurality of female retaining portions equiangularly spaced around the second end. The reel holder is adapted to hold the reel in a speaker, comprising a bottom holder member, and a top holder member. The bottom holder member has an upright flange axially extended from an inner diameter thereof at one side and a plurality of male retaining portions equiangularly spaced around the periphery of the upright flange thereof for engaging the female retaining portions to lock the reel to the reel holder. The top holder member has an upright flange axially extended from an inner diameter thereof at one side and spaced around the upright flange of the bottom holder member and defining with the upright flange of the bottom holder member an annular space for accommodating the second end of the reel. In one embodiment of the present invention, the female retaining portions are L-shaped notches formed in the second end of the reel. In another embodiment of the present invention, the female retaining portions each are comprised of a round hole and an oblique notch extended from said round hole to the bottom edge of the second end of the reel.

DETAILED DESCRIPTION OF THE INVENTION

Figure 1:
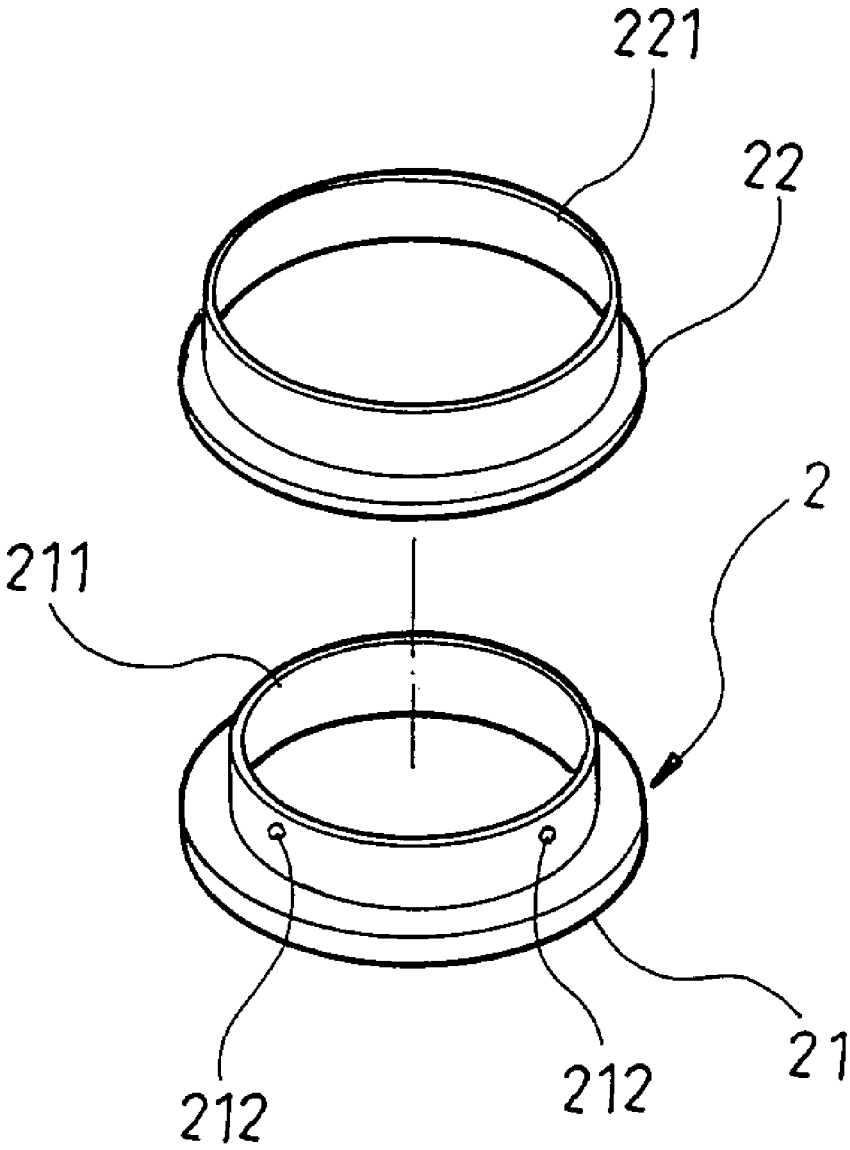
FIG. 1 is an exploded view of a reel holder for use in a voice coil mounting structure according to the present invention.
Figure 2:
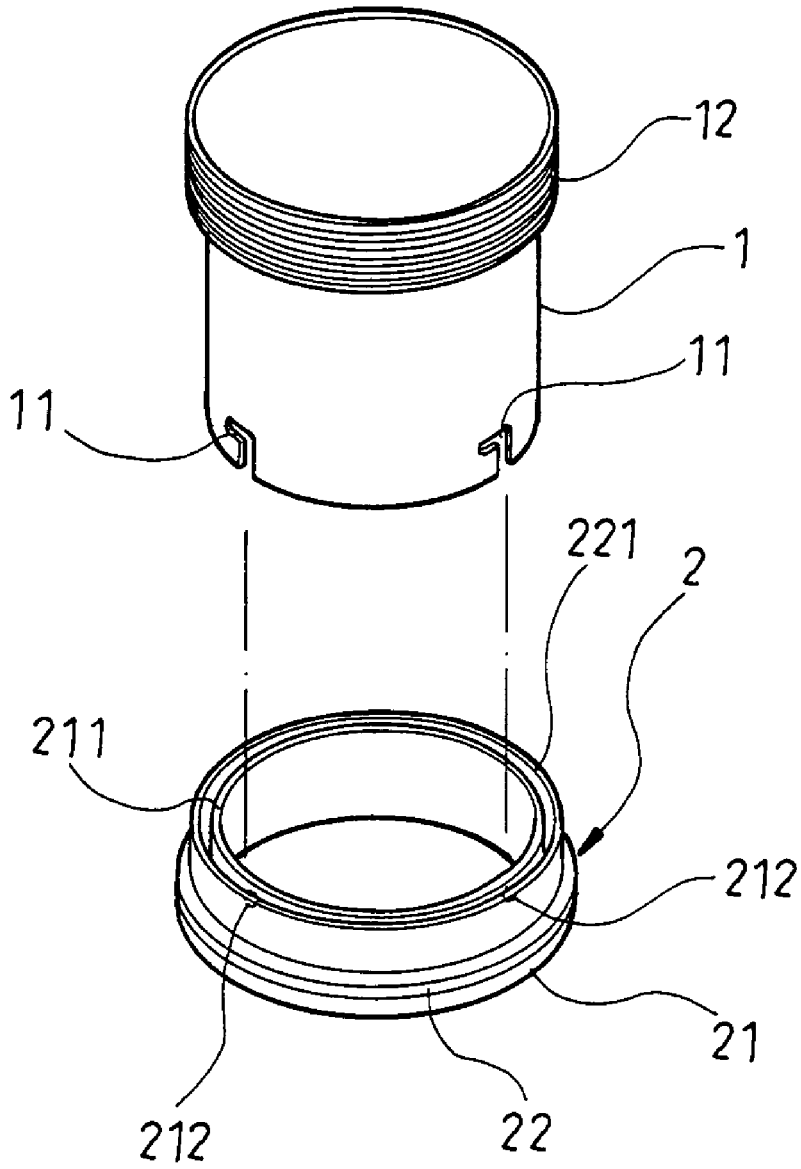
FIG. 2 is an exploded view of a voice coil mounting structure according to the present invention.

Referring to FIGS. 1 and 2, a voice coil mounting structure in accordance with the present invention is shown comprised of a reel 1, and a reel holder 2.

The reel 1 is a cylindrical member having a plurality of female retaining portions 11 equiangularly spaced around one end thereof The other end of the reel 1 is for the winding of a coil 12. According to the present preferred embodiment, the retaining portions 11 are angled notches form in one end of the reel 1.

The reel holder 2 comprises a bottom holder member 21 and a top holder member 22. The bottom holder member 21 is an annular member having an upright flange 211 axially extended from the inner diameter thereof at one side and a plurality of male retaining portions 212 equiangularly spaced around the periphery of the upright flange 211. The top holder member 22 is an annular member capped on the bottom holder member 21, having an upright flange 221 axially extended from the inner diameter thereof at one side and spaced around the upright flange 211 of the bottom holder member 21.

Figure 3:
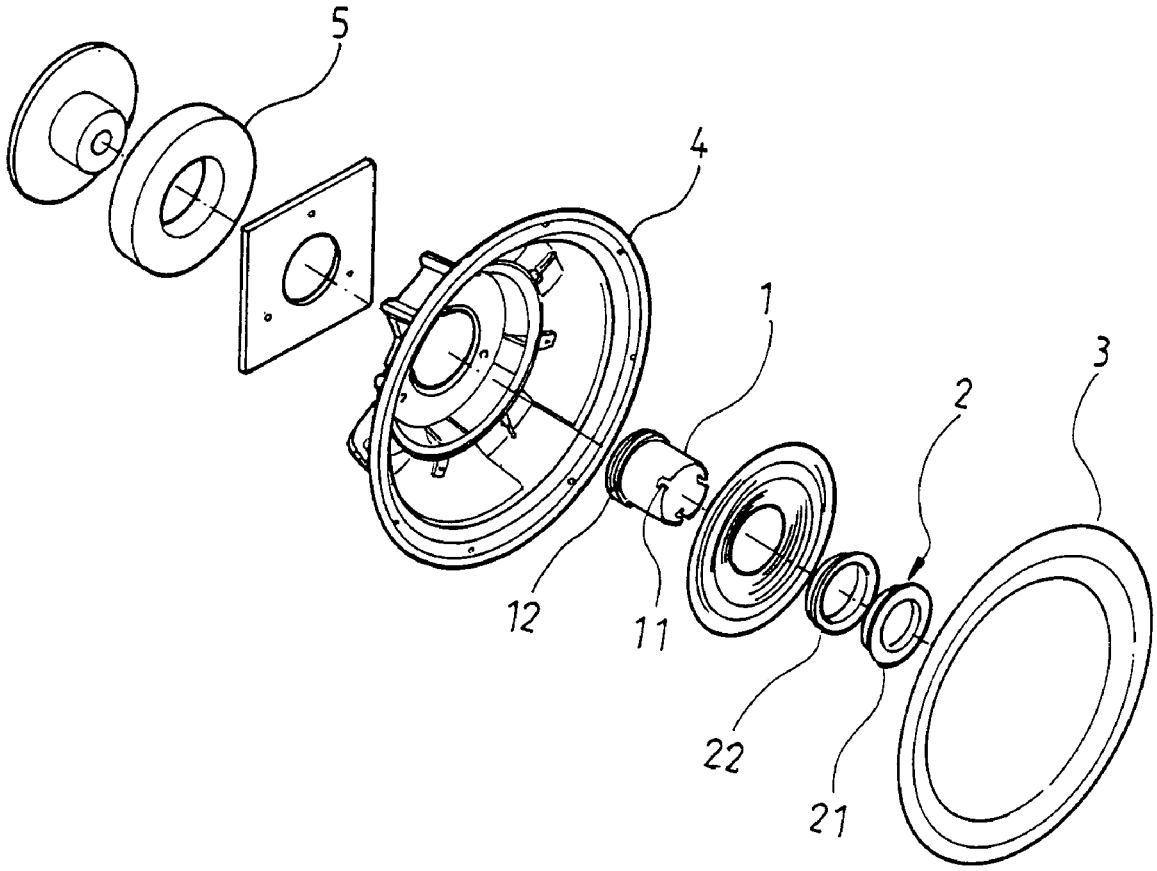
FIG. 3 is an exploded view of a speaker constructed according to the present invention.

Referring to FIG. 3 and FIGS. 1 and 2 again, the reel holder 2 is affixed to a paper cone 3, and then the reel 1 is inserted into the annular space defined between the upright flange 211 of the bottom holder member 21 and the bottom holder member 21 of the top holder member 22 to couple the female retaining portions 11 to the male retaining portions 212, and then the reel 1 is rotated through an angle relative to the reel holder 2 to lock the female retaining portions 11 to the male retaining portions 212. Thus, the reel holder 2 and the reel 1 form a voice coil, which is then fastened with the paper cone 3 to a rack 4 and a magnet 5 to form a speaker.

Figure 4:
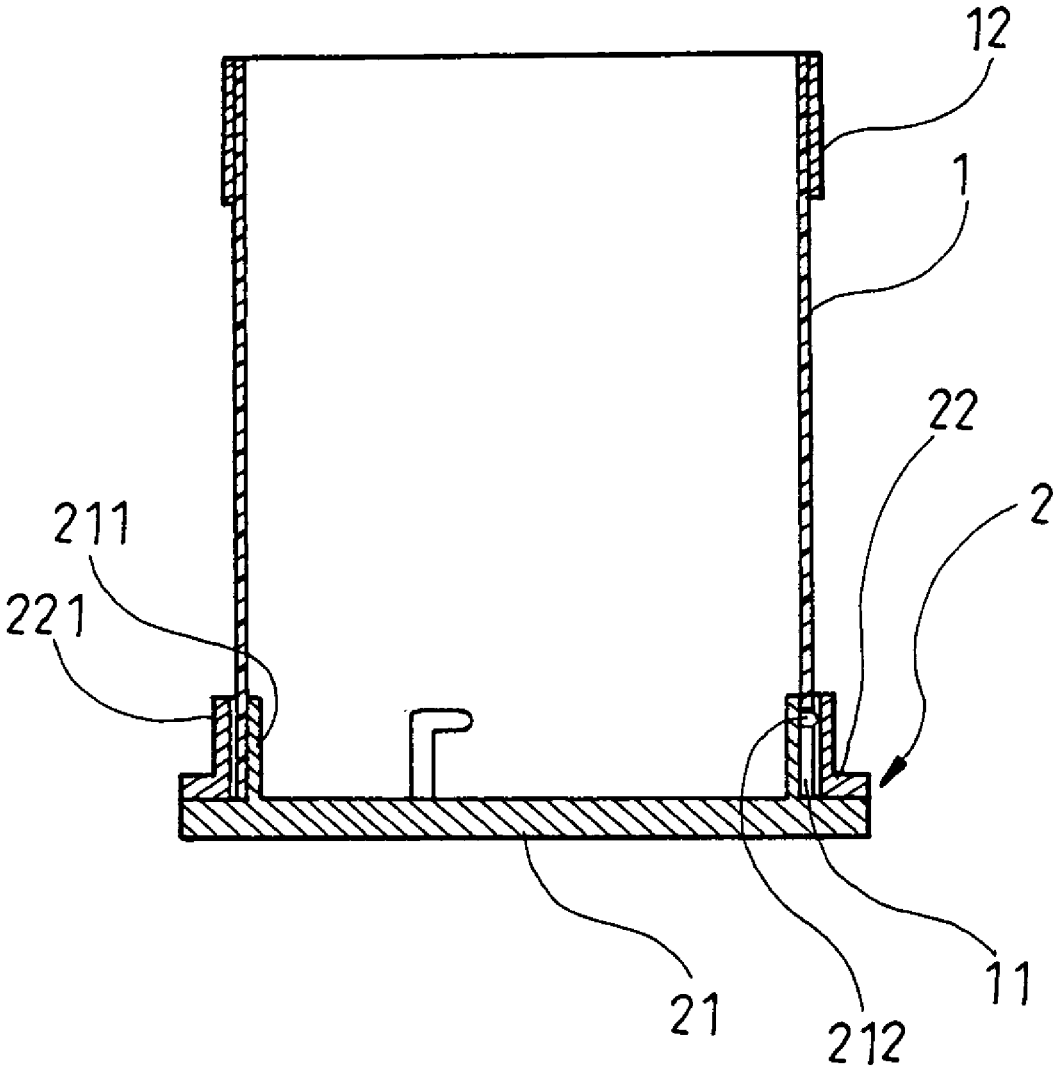
FIG. 4 is a sectional assembly view of the voice coil mounting structure according to the present invention.
Figure 5:
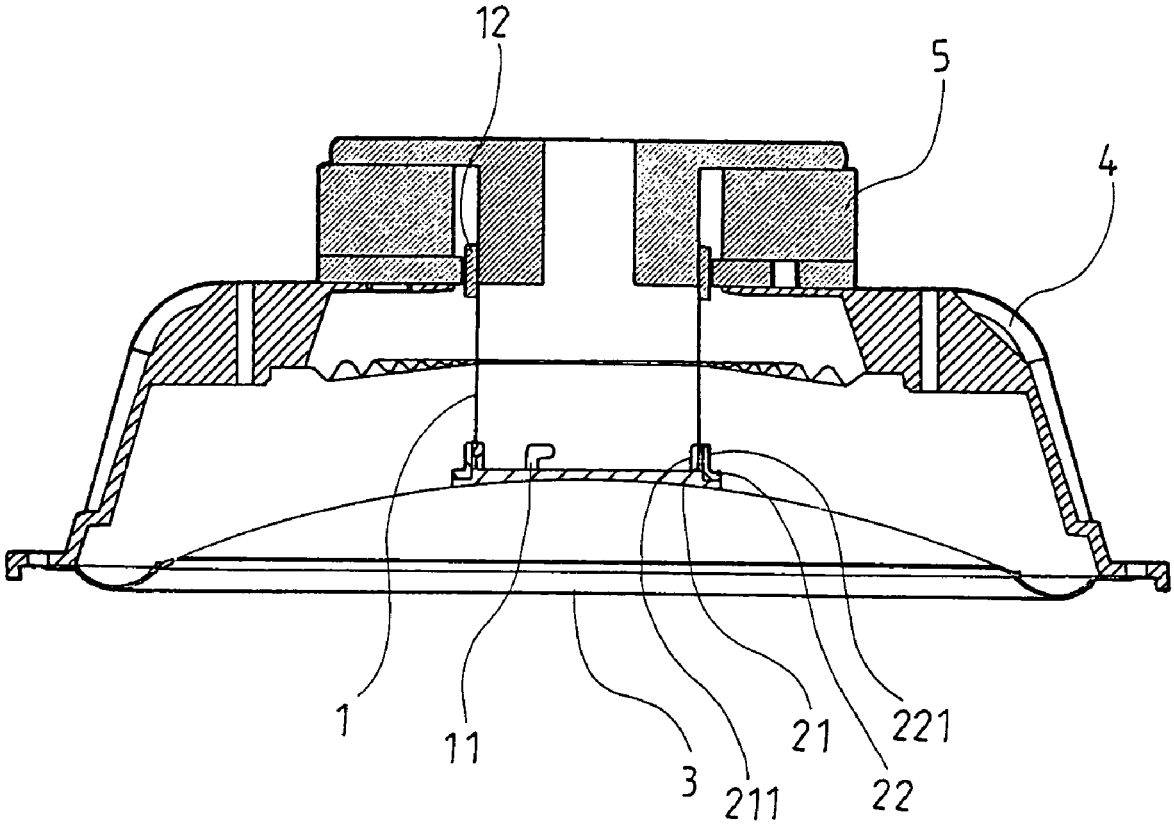
FIG. 5 is a sectional assembly view in an enlarged scale of the speaker shown in FIG. 3.

Referring to FIGS. 4 and 5, the reel 1 is mounted in the annular space defined between the upright flange 211 of the bottom holder member 21 and the bottom holder member 21 of the top holder member 22 and locked to the reel holder 2 through a rotary motion. This installation procedure is quite simple. When installed, the reel 1 is positively locked to the reel holder 2, maintaining the quality of the speaker.

Figure 6:
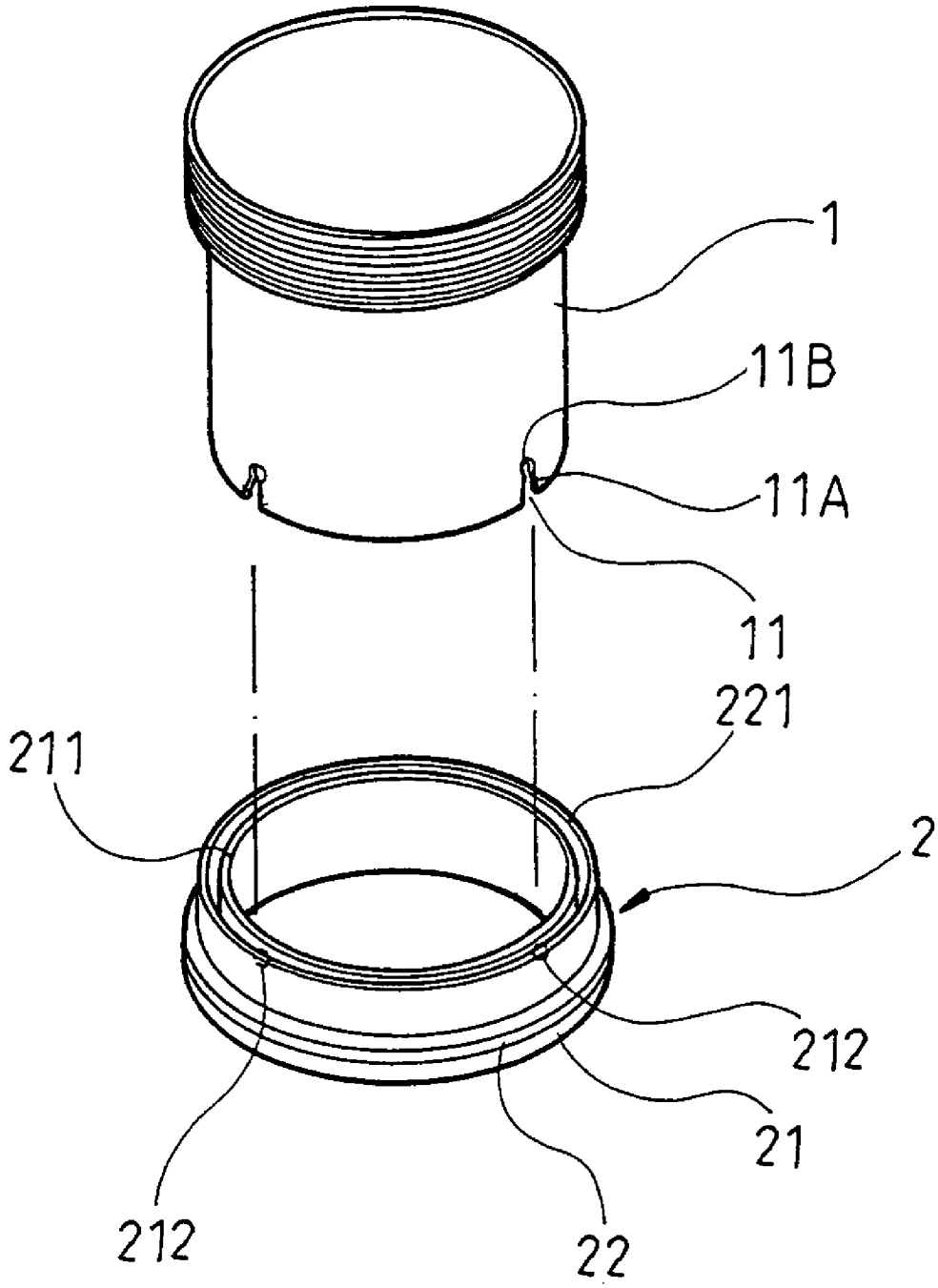
FIG. 6 is an exploded view of an alternate form of the voice coil mounting structure according to the present invention.

FIG. 6 shows an alternate form of the present invention. According to this embodiment, the female retaining portions 11 of the reel 1 each are comprised of a round hole 11B and a notch 11A obliquely extended from the round hole 11B to the bottom edge of the reel 1. The male retaining portions 212 are respectively inserted into the notches 11A of the female retaining portions 11 and then engaged into the round holes 11B of the female retaining portions 11 to lock the reel 1 to the reel holder 2.

A prototype of voice coil mounting structure has been constructed with the features of FIGS. 1~6. The voice coil mounting structure functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A voice coil mounting structure comprising:

a. reel, said reel having a first end, a second end, a coil wound round said first end, and a plurality of female retaining portions equiangularly spaced around said second end; and a reel holder adapted to hold said reel in a speaker, said reel holder comprising a bottom holder member, said bottom holder member having an upright flange axially extended from an inner diameter thereof at one side and a plurality of male retaining portions equiangularly spaced around the periphery of the upright flange thereof for engaging said female retaining portions to lock said reel to a reel holder, said top holder member having an upright flange axially extended from an inner diameter thereof at one side and spaced around the upright flange of said bottom holder member and defining with the upright flange of said bottom holder member an annular space for accommodating the second end of said reel.

2. The voice coil mounting structure as claimed in claim 1, wherein said female retaining portions are L-shaped notches formed in the second end of said reel.

3. The voice coil mounting structure as claimed in claim 1, wherein said female retaining portions each are comprised of a round hole and an oblique notch extended from said round hole to a bottom edge of said second end of said reel.

* * * * *